US007578957B2

(12) United States Patent
Chang et al.

(10) Patent No.: US 7,578,957 B2
(45) Date of Patent: Aug. 25, 2009

(54) PROCESS OF MAKING STAPLE FIBERS

(75) Inventors: Jing Chung Chang, Boothwyn, PA (US); Richard Lee Dommel, Lugoff, SC (US); Ramunas L. Valteris, Seaford, DE (US); Robert Mamoru Linek, Seaford, DE (US); Alfred Harold Thompson, Seaford, DE (US); Nirmal Kumas Agarwal, Columbia, SC (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 524 days.

(21) Appl. No.: 10/733,998

(22) Filed: Dec. 10, 2003

(65) Prior Publication Data

US 2004/0146711 A1 Jul. 29, 2004

Related U.S. Application Data

(60) Provisional application No. 60/436,989, filed on Dec. 30, 2002.

(51) Int. Cl.

| | |
|---|---|
| ***D01D 5/088*** | (2006.01) |
| ***D01D 5/16*** | (2006.01) |
| ***D01D 5/22*** | (2006.01) |
| ***D01F 6/62*** | (2006.01) |

(52) U.S. Cl. ..... 264/168; 264/210.5; 264/210.7; 264/210.8; 264/211.14; 264/211.17; 264/234

(58) Field of Classification Search ..... 264/143, 264/168, 210.7, 210.8, 211.14, 211.17, 234, 264/289.3, 289.6, 290.5, 345, 210.5
See application file for complete search history.

(56) References Cited

U.S. PATENT DOCUMENTS

| | | | | |
|---|---|---|---|---|
| 3,584,103 | A | 6/1971 | Harris | |
| 3,681,188 | A | 8/1972 | Harris | |
| 3,816,486 | A * | 6/1974 | Vail | 264/289.6 X |
| 4,257,604 | A | 3/1981 | Grabel et al. | |
| 5,187,845 | A | 2/1993 | Duffy et al. | |
| 5,645,782 | A | 7/1997 | Howell et al. | |
| 5,662,980 | A | 9/1997 | Howell et al. | |
| 5,782,935 | A | 7/1998 | Hirt et al. | |
| 6,109,015 | A | 8/2000 | Roark et al. | |
| 6,113,825 | A | 9/2000 | Chuah | |

(Continued)

FOREIGN PATENT DOCUMENTS

EP 0745 711 A1 12/1996

(Continued)

OTHER PUBLICATIONS

International Search Report (Date mailed: May 28, 2004).

(Continued)

*Primary Examiner*—Leo B Tentoni

(57) ABSTRACT

Improved staple fibers and processes for producing them are provided. The processes are particularly useful for forming staple fibers from poly(trimethylene terephthalate), especially carpet staple fibers. The processes include prewetting undrawn yarns and drawing the fibers under wet and warm conditions, thermo-fixing the texture, and drying at relatively low temperatures. Fibers produced according to the processes disclosed herein have improved properties and reduced brittleness as compared to fibers prepared using conventional processes.

38 Claims, 1 Drawing Sheet

U.S. PATENT DOCUMENTS

| | | | | |
|---|---|---|---|---|
| 6,210,622 | B1 | 4/2001 | Reese et al. | |
| 6,242,091 | B1 | 6/2001 | Howell et al. | |
| 6,254,961 | B1 | 7/2001 | Chuah | |
| 6,312,805 | B1 | 11/2001 | Sun | |
| 6,383,632 | B2 | 5/2002 | Howell et al. | |
| 6,423,407 | B1 | 7/2002 | Abe et al. | |
| 6,458,455 | B1 | 10/2002 | Hernandez et al. | |
| 6,539,596 | B1 | 4/2003 | Hwo et al. | |
| 6,572,967 | B1 * | 6/2003 | Abe et al. | 428/364 |
| 6,576,340 | B1 | 6/2003 | Sun et al. | |
| 6,685,859 | B2 | 2/2004 | Howell et al. | |
| 6,740,276 | B2 | 5/2004 | Agarwal et al. | |
| 6,752,945 | B2 | 6/2004 | Hernandez et al. | |
| 2001/0030378 | A1 | 10/2001 | Howell et al. | |
| 2002/0012763 | A1 | 1/2002 | Chuah | |
| 2002/0071951 | A1 | 6/2002 | Hernandez et al. | |
| 2002/0130433 | A1 | 9/2002 | Hwo et al. | |
| 2002/0153691 | A1 | 10/2002 | Hernandez et al. | |
| 2004/0001950 | A1 | 1/2004 | Chang et al. | |
| 2004/0151904 | A1 | 8/2004 | Ding et al. | |

FOREIGN PATENT DOCUMENTS

| | | | |
|---|---|---|---|
| EP | 1016741 | A1 | 7/2000 |
| GB | 992670 | A * | 5/1965 |
| GB | 1254826 | | 11/1971 |
| JP | 11-089869 | | 4/1999 |
| JP | 11-107149 | | 4/1999 |
| JP | 2000178828 | A | 6/2000 |
| JP | 2001262435 | A | 9/2001 |
| WO | WO 01/07693 | A1 | 2/2001 |
| WO | WO 01/68962 | A2 | 9/2001 |
| WO | WO 02/14999 | A2 | 3/2002 |
| WO | WO 02/18684 | A1 | 3/2002 |
| WO | WO 02/22925 | A1 | 3/2002 |

OTHER PUBLICATIONS

C. Hwo et al., "Nonwovens from Poly(Trimethylene Terephthalate) Staple", www.corterra.com Shell (2000).

Corterra® Polymers, "Textile Staple Production", www.corterra.com Shell (2000).

H.S. Brown et al., "Poly(Trimethylene Terephthalate) Polymers for Fibers", www.shellchemicals.com/corterra (Shell Chemicals 1999).

Corterra® Polymers, "The Very Fiber of Performance", www.shellchemicals.com/corterra (Shell Chemicals Ltd. 1999).

F. Wemy et al., "CorterraPTT—A New Polymer for the Carpet Industry", www.shellchemicals.com/corterra (Shell Chemicals Ltd. 1999).

H. Chuah et al., "Corterra Poly(trimethylene terephthalate)—New Polymeric Fiber for Carpets", www.shellchemicals.com/corterra (Shell Chemicals Ltd. 1999).

* cited by examiner

PROCESS OF MAKING STAPLE FIBERS

This application relates to and claims priority benefits from U.S. Provisional Patent Application Ser. No. 60/436,989, filed Dec. 30, 2002.

FIELD OF THE INVENTION

The present invention relates to staple fibers and processes for producing them. The processes are particularly useful for producing fiber from poly(trimethylene terephthalate), especially carpet staple. The processes allow the production of staple yarns from aged, undrawn fiber.

BACKGROUND

Polyalkylene terephthalates such as polyethylene terephthalate ("2GT") are common commercial polyesters. They have excellent physical and chemical properties, including chemical, heat and light stability, high melting point and high strength. As a result they have been widely used for resins, films, and fibers.

A key difference between drawing nylon and PET fiber lies in the temperature to which the undrawn yarn is raised to allow the fibers to start drawing in a uniform manner with a reasonable draw force. Nylon and PET can be drawn at room temperature but are best drawn at a temperature above their glass transition temperatures of about 40° C. and 65° C. respectively to obtain uniform physical properties and/or preclude undue filament breakage during drawing. The glass transition temperature ($T_g$), also called the second order transition temperature, can be obtained by dilatometric methods. The undrawn yarn can be raised to above its $T_g$ before drawing with draw assists such as heated rolls.

The making of polyester and nylon staple fibers often involves a multi-stage process. In the first step, polymer is extruded into filaments, which are quenched, attenuated, and lubricated; and the filaments of each spin position are combined into a filament bundle. Filament bundles from the individual spin positions are then immediately combined at the spinning wall into a spun rope. Drawing of the spun rope to form an oriented structure having useful properties is often done in a separate step, wherein the spun rope is piddled into a can for subsequent drawing and texturing. The spun cans are assembled into a creel of economic size, for drawing at the drawing machine. In this split spin/draw staple process, there is an inherent time delay between the extrusion and drawing process to allow for producing such a creel for drawing. This delay is often substantial and depends, in part, on the number of spin positions and spin rate of the spinning machine. Further, production schedules can extend the delay before drawing to days rather than hours.

After the fiber is drawn to give it adequate strength for downstream processing and end use, it is textured and lubricated to provide appropriate fiber friction and value. A stuffing box crimper usually carries out the nylon and PET staple texturing. The crimping equipment and process conditions can impact the type, frequency, and permanence of the crimp. The crimped tow can be pre- or post treated with lubricants, dried, relaxed or annealed, and cut into staple fibers and baled. The operations from drawing to baling can be carried out in separate steps or in a coupled process. The optimum conditions depend on the fiber composition and end use, and the cut length depends on end use and staple processing system i.e. cotton, wool, modified worsted. The cotton system equipment generally uses short fibers (1-3 inches) for textile applications and the modified worsted system, used for carpet processing, uses longer fibers (6-8 inches).

Bales of the cut staple fibers are converted into a continuous yarn in a multi-stage mill operation-using opening, blending, carding, drafting, and spinning equipment. Certain physical properties are highly desirable in the fibers so that they can undergo the drawing and texturing processes without diminished quality in the resulting fiber. One of the most critical parameters is crimp frequency (crimps per inch, c.p.i) and its permanence (crimp take-up, CTU). It is desirable that the staple fibers have enough crimp to provide adequate sliver cohesion but not too much to cause excessive fiber entanglement in operations such as blending. The crimp should be permanent enough to withstand the considerable forces in mill processing. For example, when such fibers are carded to comb them to parallelism, they can, because of entanglement, be snarled into defects or stretched until crimp is permanently removed or the filaments break. Also if the crimp is lost, either from stretching or due to insufficient permanence, the sliver leaving the card can have insufficient strength and cohesion and could break and prevent further operation. Even though the CTU is increased with crimp frequency, it is desired that the fiber have a balance of crimp frequency and CTU to prevent excessive entanglement from too high crimp. Carpet fibers have higher denier than textile fibers and are stiffer so they require lower crimp levels to prevent entanglement. In addition, any crimp loss reduces the bulk of the yarn, which reduces the value of the carpet. Lower yarn bulk provides less cover and so requires more weight for equal cover. Processing lubricants are applied to help control fiber-to-fiber and fiber-to-metal friction, and provide static protection. In carpet production, the spun yarns are typically plied, heatset to set the twist, tufted into a primary backing, and dyed. Then, a secondary backing is applied to the primary backing, using a latex adhesive, which locks in the tufts and provides dimensional stability to the carpet.

Poly(trimethylene terephthalate), also referred to as PTT or 3GT is a polyester suitable for use in carpet, textile, and other thermoplastic resin applications. Poly(trimethylene terephthalate) in fiber form is desired because it can be dyed at atmospheric pressure with disperse dyes, has a relatively low bending modulus, a relatively high elastic recovery and resilience, and resistance to staining. However, undrawn PTT yarns, under some spinning conditions can become brittle upon aging (e.g., storage). Conventional two-step processes used for making polyester staple fibers, as mentioned hereinabove, include an inherent time delay between the extrusion and drawing process, which effectively ages the fibers. Brittle fibers can be difficult to draw and may even be undrawable.

U.S. Pat. No. 6,109,015 discloses an attempt to overcome the problem of brittleness in PTT. The patent discloses a continuous process for producing PTT yarn stated to have improved wear over yarns made in conventional two stage processes. The continuous process avoids the aging of the fiber by eliminating the storage step by coupling the spin and draw steps. However, the process also requires major equipment modifications, which prevents the use of existing conventional two-step equipment.

Other efforts to overcome problems associated with aging of undrawn yarns were directed to reduction or control of shrinkage. For example, Patent Publication No. WO 01/68962 A2 discloses a two-step process for producing fine denier textile yarns from poly(trimethyelene terephthalate) on equipment with relatively long quench zones. The first step produces undrawn yarn, and the second step converts the undrawn yarn to a staple fiber. The process includes preconditioning the fiber under tension at a temperature of 60° C. or above, then drawing the fiber, at a temperature of 60° C. or above, preferably to 80-85% of the total draw length of the fiber. After an optional second drawing stage, the fiber is relaxed at a temperature of up to 190° C.

In certain textile end uses, staple fibers are preferred over continuous filament. Examples include staple spun yarns for apparel fabrics (1-6 dpf) and carpet (6-25 dpf) both of which require discontinuous fiber rather than continuous to permit use of textile staple processing equipment. The manufacture of staple fiber suitable for fabrics and carpets can present special problems, particularly in conventional split spin/draw processes where the drawing is carried out in a separate step. A need thus remains for processes for manufacturing fiber, and particularly staple fiber, from PTT.

SUMMARY OF THE INVENTION

The present invention provides processes for forming staple fiber from PTT fibers. In particular, the processes disclosed herein include steps of drawing, crimping, and drying. PTT fibers produced according to the processes disclosed herein are particularly suitable for use as carpet yarns. The processes are suitable for processing undrawn yarn ("UDY"), including aged undrawn yarn, which is generally stored for some time before being drawn in a split spin/draw process, and can be too brittle to be drawn in a conventional manner using conventional equipment. The processes disclosed herein allow the processing of undrawn PTT yarns into staple fibers with little or no brittleness due to fiber aging during storage and/or processing of the undrawn yarn. Another advantage is that conventional nylon or PET equipment can be simply modified to produce the improved fiber. The PTT fibers can be melt spun in a conventional manner.

One aspect of the present invention is a process for making an improved 6 to 25 dpf staple fiber consisting essentially of poly(trimethylene terephthalate). Such staple fibers are commonly used in carpet applications. For example, carpet fibers can be about 10, 15, or 20 dpf. However, it is contemplated that the processes of the invention are useful in making fibers of all deniers within the recited ranges. The process includes: prewetting an undrawn yarn at a temperature less than about 45° C., more preferably less than about 40° C., and even more preferably at about 25° C.; drawing the fiber under wet conditions at a temperature from about 45° C. to about 95° C. in a first stage to about 30-90 percent of its final length; drawing the fiber in a second stage at a temperature from about 60° C. to about 98° C. under wet conditions; crimping the drawn fiber; thermo-fixing the crimped fiber with steam at a temperature from about 80 to about 100° C., preferably at about 85°; and drying and relaxing the fiber. Preferably, the fiber is drawn at a temperature of about 50° C. in the first stage and at a temperature of about 60° C. in the second stage, and the crimped fiber is dried at a temperature from about 60° C. to about 120° C. Wet conditions can be, for example, in the presence of water and/or steam, such as under water or under an aqueous solution of processing finish. Preferably, the undrawn yarn is prewet and drawn in a manner that exposes the maximum fiber area practical to the wetting medium to insure the most uniform treatment.

These and other embodiments will be apparent to those skilled in the art, in view of the following description and the appended claims.

DETAILED DESCRIPTION

Figure 1:
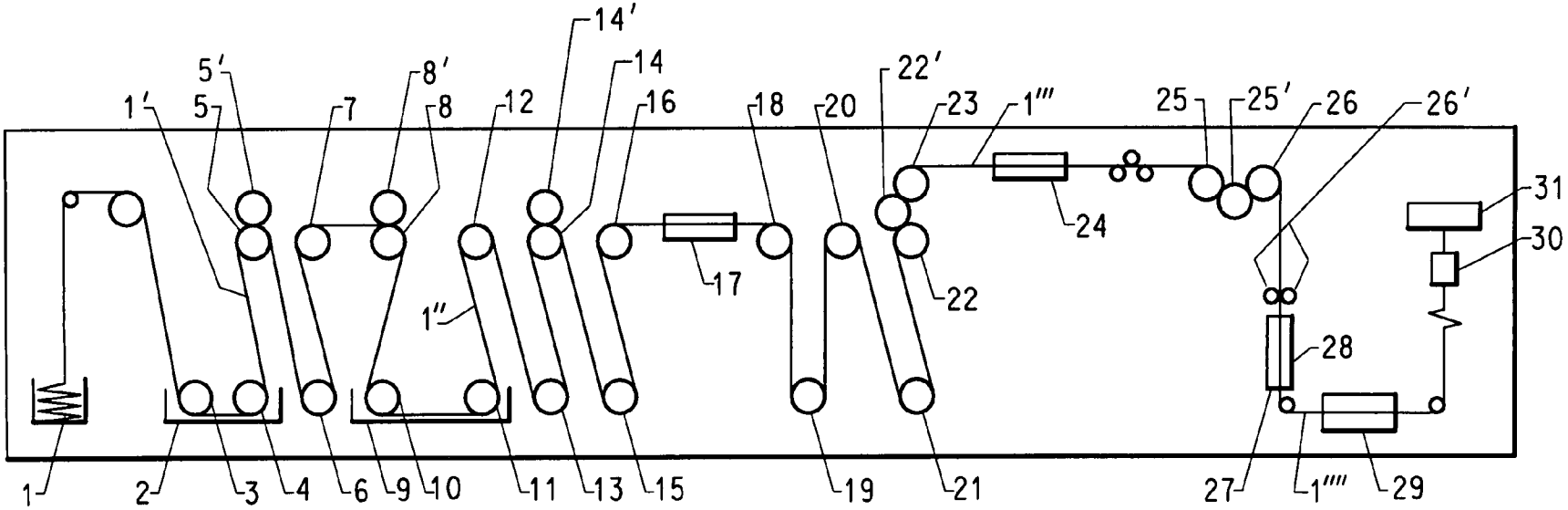
FIG. 1 is a schematic representation of exemplary equipment used in a process according to the invention for making fiber from poly(trimethylene terephthalate).

Unless otherwise stated, the following terms when used herein have the following definitions. Measurements reported herein are reported using conventional U.S. textile units, including denier, which is a metric unit. Specific properties of the fibers were measured as described below. When available, definitions hereinbelow were taken from *The Man-Made Fiber and Textile Dictionary,* Fourth Edition, Reprinted 1986, Celanese Corporation, which is incorporated herein by reference in its entirety.

Where a range of numerical values is recited herein, unless otherwise stated, the range is intended to include the endpoints thereof, and all integers and fractions within the range. It is not intended that the scope of the invention be limited to the specific values recited when defining a range. Moreover, all ranges set forth herein are intended to include not only the particular ranges specifically described, but also any combination of values therein, including the minimum and maximum values recited.

"Staple" refers to either natural fibers or cut lengths from filaments. The term staple (fiber) is used in the textile industry to distinguish natural or cut man-made fibers from filament. Man-made fibers are cut to a specific length, for example, as long as 8 inches or as short as 1.5 inches or less, so they can be processed on cotton, woolen, or worsted yarn spinning systems, or flocked.

"Relative viscosity", also called "laboratory relative viscosity" (LRV) is the viscosity of a polymer dissolved in hexafluoroisopropanol containing 100 ppm of 98% reagent grade sulfuric acid (HFIP solution). The viscosity measuring apparatus is a capillary viscometer obtainable from a number of commercial vendors (for example, Design Scientific, Cannon). The relative viscosity in centistokes is measured on a 4.75 wt. % solution of polymer in HFIP solution at 25° C. as compared with the viscosity of pure HFIP solution at 25° C.

"Quench zone" is used herein with regard to equipment for processing PTT fibers to refer to the cooling distance from the spinneret from which polymer is extruded to make a spun fiber, to the roll that is used to forward the spun fiber at draw-off speed to cans for subsequent drawing.

A "draw creel" is a framework arranged to guide the ends from a number of containers (cans) so that many ends can be withdrawn smoothly and evenly without tangling and be forwarded into a draw machine (beam). A creel stock is the aggregate of the supply UDY cans to be drawn at one time.

"Undrawn yarn" is a term customarily applied to fiber that has not been drawn, and is not intended herein to include fibers that have been drawn and processed into a yarn product, such as those yarns used in knitting or weaving fabric. After melt spinning, undrawn yarn is accumulated until an appropriate total denier for the draw machine is produced. Accumulation can take up to 24 hours or more including dormant or storage time between steps. For example, making sufficient undrawn yarn for economic drawing at the draw line generally takes 6 hours or more. Due to production scheduling and other practical considerations, fiber may be stored for several days. Fiber having been exposed to such storage time is referred to as "aged" or "aged undrawn yarn".

"Draw ratio", or "draw down", is the amount by which filaments are stretched following melt spinning. As used herein, "draw ratio" refers to machine draw ratio, which is the ratio of the surface speed of the pulling rolls to the forwarding rolls (rolls that move the fiber). As a result of pulling some stretching occurs.

"Modification Ratio" (MR) refers to the shape of a trilobal filament. It is the ratio of the circumscribed or outer diameter of the filament lobes divided by the inscribed diameter or diameter of the core. It can be measured using transparent calibrated templates or digital imaging methods. The higher the number, the longer are the three lobes of the trilobal filament.

"Crimp" is the texture or waviness of a fiber expressed as crimps per unit length. Crimp frequency, reported in crimps per inch (cpi), is an indirect measure of yarn bulk. Crimp frequency is measured in the following manner. A filament is placed between two clamps, and then a tension of 2 mg/denier is applied to the filament. The number of crimps between the clamps is counted. Next a 50 mg/denier tension is applied and the extended length is recorded. The process is repeated until ten filaments have been measured. The results are averaged, and from the averaged results the cpi is calculated as follows: CPI=(number of crimps in filament)/(extended length).

"Tow" is a large strand of continuous man-made fiber filaments without definite twist collected in loose, rope-like form, usually held together by crimp. Tow is the form the fiber reaches before being cut into staple.

"Final length", as used herein in reference to drawn fibers, refers to the total length to which a fiber is drawn.

"Crimp Take-Up" (CTU, %) is a measure of fiber's resilience. CTU indicates how well a specified frequency and amplitude of the secondary crimp is set in the fiber. CTU relates the length of the crimped fiber to the extended fiber and thus it is influenced by crimp amplitude, crimp frequency, and the ability of the crimps to resist deformation. Crimp take-up can be calculated using the formula:

$$CTU(\%)=100(L_1-L_2)/L_1$$

wherein $L_1$ represents the extended length (fibers hanging under an added load of 0.13_+0.02 gpd for a period of 30 seconds), and $L_2$ represents the crimped length (length of the same fibers hanging under no added weight after resting for 60 seconds after the first extension.

"Carding" is a process whereby staple is aligned and formed into a continuous untwisted strand called sliver. The card machine consists of a series of rolls whose surfaces are covered with many projecting metal teeth.

A "sliver" is a continuous strand of loosely assembled fibers without twist. Sliver is delivered by the card or drawing frame. The production of sliver is the first step in the textile operation that converts staple fiber into a form that can be drawn and eventually twisted into a spun yarn.

"Sliver tenacity" is defined as the weight needed to break a sliver divided by the sliver weight. The strength or cohesion of fibers can be measured by a sliver tenacity test and is helpful in determining the performance of fibers in textile processing. For example, the sliver desirably has sufficient cohesion that it does not break as it is being forwarded in the carding or drafting operation. To measure sliver tenacity, a length of sliver is taped at one end and the opposite (untapped) end is placed in a clamp. Weights are then successively placed on the taped end of the sample in 10 second intervals until the sliver breaks. Sliver tenacity=weight to break (grams)/sliver weight (grains).

"Bulked yarn" is a qualitative term to describe a textured yarn. "Carpet bulk" is carpet pile weight, relative to other fibers, for equivalent substance (resistance to compression) and cover. It can be measured with various compression instruments. In the present Examples, carpet bulk was assessed based on subjective comparative tests by a panel of carpet experts.

Twisting is the process of combining filaments into a textile yarn on a spinning frame. "Twist" is the number of turns about its axis per unit length of a textile yarn. Twist can be expressed as turns per inch (tpi).

The "gauge" (ga.) is the distance in inches between needles on a carpet tufting machine.

The present invention provides improved processes for forming fibers from PTT. The processes include prewetting quenched undrawn yarn preferably at temperatures below the $T_g$ of the yarn, and drawing quenched, undrawn PTT yarn filaments at temperatures preferably above their $T_g$ and under wet conditions, e.g., in the presence of water and/or steam.

The present inventors have found that if PTT undrawn yarn is processed using conventional melt spun processes known for producing nylon carpet fiber, the fiber exhibits extreme brittleness within a short time after extrusion. The brittleness results in a weak fiber that can be easily snapped even under low tension. The surprising structure changes over time, which do not occur with PET polyester or nylon, prevent or interfere with subsequent drawing intended to orient the structure and give it useful strength. Also, after drawing, when some conventional processes known for use with certain other fibers are used for forming PTT staple fibers, there can be severe fiber crimp loss and hence insufficient sliver cohesion for downstream mill processing such as carding. Prevention of insufficient sliver cohesion and attaining high carpet bulk is desirable. It is also desirable for economic reasons to be able to use conventional nylon or polyester equipment for the production of PTT staple.

In preferred embodiments, standard equipment such as that conventionally used in making yarn from PET or nylon can be used in the processes disclosed herein. An exemplary preferred embodiment is illustrated schematically in FIG. 1. Undrawn yarn ("UDY") 1, having been spun and passed through the quench zone (not shown), enters prefeed dip tank 2 and is forwarded by rolls 3 and 4 and wetted under water (water level not shown). Wetted UDY 1' is forwarded by rolls 5, 6, 7, 8, and 10, then enters first drawing stage ("Draw 1") in dip tank 9 and is partially drawn between rolls 10 and 11 under water in first stage dip tank 9. The yarn is partially drawn by rolls 11, 12, 13, 14, 15, and 16, which are driven at a faster speed than roll 10. The partially drawn yarn 1" is then rewetted by water spray jets 17. Optionally, a steam jet or another dip tank can be used in place of water spray jets. Further drawing ("Draw 2") is achieved by rolls 18,19, 20, and 21, and puller rolls 22 and 23, which are driven at a faster speed than roll 16. Nip rolls 5, 8', 14', 22' and 25' are used to minimize yarn slippage. After the yarn has gone through the second drawing stage, finish sprayer 24 applies a dilute processing finish to the drawn yarn 1''', which is then forwarded and maintained under tension by puller rolls 25 and 26, until it is forced into stuffer box crimper 27 by driven crimper nip rolls 26', where it is crimped and thermofixed by application of steam at 28. The crimped yarn 1'''', called "tow", is then forwarded in a relaxed state through a conventional belt dryer 29, cut by rotary cutter 30 and baled 31 for storage and shipping.

The processes disclosed herein provide not only the ability to draw aged, brittle PTT undrawn yarn, but also provide fiber having improved physical properties. The processes also provide fiber having improved sliver cohesion after carding and improved bulk as compared to fibers drawn using conventional processes. The processes are preferably used to draw 5-60 dpf undrawn yarn. Fibers prepared according to the processes disclosed herein thus provide a balance of physical properties, mill processibility, and carpet bulk. The processes can also be carried out by modifying equipment designed for production of either nylon or 2GT polyester staple.

In the processes disclosed herein, prior to being drawn, PTT fiber, produced by conventional melt spinning, is prewet to improve temperature uniformity throughout the fiber prior to the carrying out of further processing steps. Prewetting can be carried out in a dip tank. The temperature of the dip tank is preferably below about 45° C., more preferably less than about 25° C. if the fiber is under tension. If the prewetting is carried out a temperature close to the glass transition of the polymer, it is desirable to control the tension on the fiber to prevent uneven drawing of the fiber before the drawing stage.

In a preferred embodiment, after wetting, the fiber is drawn in at least two stages. In a first stage, the fiber is drawn, with the fiber being maintained at a temperature of at least about 45° C. and not higher than about 95° C. Preferably, the temperature is about 80° C. or less, more preferably about 70° C. or less, even more preferably about 60° C. or less. Even more preferably, the first drawing stage is carried out at a temperature from about 50° C. to about 55° C. The temperature of the fiber during the drawing stages is not necessarily equivalent to the ambient temperature, as the fiber can be drawn in steam, which has a temperature of 100° C. or more.

In the first drawing stage, for fiber suitable for use in carpet, the fiber is drawn to at least about 30 percent of its final length, preferably at least about 40 percent, and more preferably to about 50 percent of its final length. Also, the fiber is drawn to about 90 percent of its final length or less, preferably about a 70 percent or less, and more preferably about 55 percent or less. For finer denier textile fibers, it is preferred that a higher proportion of the total draw be carried out in the first draw stage than for higher denier fibers.

In the first drawing stage, the fiber is drawn under wet conditions. "Under wet conditions" is a term readily understood by persons of ordinary skill in the art and includes, for example, under water, under a spray, and in a humid environment. In highly preferred embodiments, the fiber is drawn under water or an aqueous solution of processing finish also referred to as "dilute finish." Even more preferably, the fiber is drawn under water as a spun rope that is spread into a band as wide as practical, preferably controlling the thickness of the band and maintaining it as wide as possible, to permit uniform wetting and heating, at about 50° C. and to about 55% of the final draw length. The spun rope can be substantially rectangular in shape. It is highly preferred that the spun rope have a transverse thickness less than about 300,000 denier per inch of draw roll width for carpet fibers, and less than about 200,000 denier per inch of draw roll width for apparel fibers. As the fiber is drawn, the width of the rope may remain substantially the same, while the transverse thickness generally decreases during drawing. Thus, the transverse thicknesses of less than about 300,000 denier per inch and less than 200,000 denier per inch will be understood by one skilled in the art to refer to initial deniers.

The fiber is then drawn in a second stage at a temperature of about 45° C. or more, and up to about 98° or less, under wet conditions. For example, as in the first drawing stage, the fiber can be drawn under water, under dilute finish, under a water spray, or wetted by steam, for example by a steam jet. The temperature of the fiber during the second drawing stage is preferably maintained from about 50° C. to about 95° C., more preferably about 60° C. to about 80° C. Preferably, the fiber is drawn at a rate of 220 yards per minute (ypm) or less. More preferably the fiber is drawn at a rate of 100 ypm or less. Too high a draw temperature was surprisingly found to gradually reduce drawability.

The preferred draw ratio depends on the fiber denier and desired properties. For example, for 12-20 dpf fibers, it is desired that the undrawn yarn have mechanical draw ratios in the range of 3:1 to 5:1 to obtain useful properties for carpet fibers. It is preferred that the draw ratio is high enough to obtain desired fiber tenacity and also high enough to allow the fiber to be drawn down to a substantially uniform cross-section. Uniformity of the cross-section of the fiber can be measured and quantified using the denier range or standard deviation of elongation, as illustrated in the present examples hereinbelow. For example, it has been found that a draw ratio of about 3.5:1 or greater is desirable in order to obtain substantial uniformity for 14 to 18 dpf fibers. Higher spinning speeds or finer deniers result in more structural orientation, which makes the fiber harder to draw and usually requires lower draw ratios to obtain the same physical properties, including tenacity and elongation. It is highly desired to minimize or eliminate undrawn sections in the fiber, which can be harsh and/or brittle. The particularly preferred draw ratio for a specific fiber can vary depending on, for example, the intended use of the fiber, and can be selected by one skilled in the art. For a given denier fiber, a slower spinning speed results in a lesser amount of fiber structure orientation, making drawing easier.

In general, carpet fibers require higher draw ratios than do lower dpf textile fibers because carpet fibers are produced at a lower spinning speed, which changes the structure of the fibers and lowers the degree of spin orientation. Thus, higher dpf undrawn PTT carpet yarns require more draw orientation than lower dpf fibers. Sufficient orientation is also required to stabilize the structure of the fiber and obtain adequate, uniform physical properties.

While it has been observed that warming of the fiber alone, for example with heated rolls, can provide some improvement in processing and properties, the present inventors have now found that it is highly preferred that the fiber be kept wet during all steps of the draw process. While it is not intended that the invention be bound by any particular theory or mechanism, it is believed that wetting the fiber creates substantially uniform temperatures throughout the fiber due to the heat transfer capability of water, plasticizes the fiber, and lowers and/or or renders more uniform the forces applied to initiate drawing. Thus, uniform moisture application to each filament is desirable, to achieve sufficiently high fiber orientation, uniformity, and strength.

The relatively slow spin speeds (less than 600 ypm) that may be used in spinning higher dpf fibers, e.g., carpet fibers, on conventional equipment designed with higher spinneret capillary (also called "spinneret hole") densities and shorter quench zones (for example, less than 16 feet) can result in brittle fibers in such conventional processes. With such equipment, it is generally preferred that the higher dpf fiber be spun at a speed less than 600 ypm, often about 500 ypm or less, even about 500 ypm or less, and in some embodiments about 400 ypm or less. For some higher dpf fibers, for example 14-20 dpf fibers, spin speeds of about 450 ypm or less, 400 or less, and even 350 ypm or less, are appropriate.

The present inventors have found that, for spinning carpet yarn, the processes disclosed herein are particularly useful on equipment having a capillary density of at least about 2/cm$^2$. Also, for textile yarns, the processes disclosed herein are particularly useful on equipment having a capillary density of at least about 8/cm$^2$. As will be recognized by those skilled in the art, for a given throughput of polymer, finer denier textile fibers are generally spun at faster speeds than carpet yarns and can have higher capillary densities, as the relatively higher surface area of the textile fibers permits faster quench cooling.

For example, the finer denier textile fibers can be spun at speeds of 900 ypm, or even 1300 ypm, depending on the denier.

The processes disclosed herein are particularly advantageous for use on equipment having a quench zone length less than 16 feet. Generally, the length of the quench zone is at least about 12 feet, although quench zones shorter than 12 feet can be used. As will be recognized by those skilled in the art, a shorter quench zone may require adjustments in other conditions and parameters, such as throughput and speed.

After being drawn, the fiber is crimped. The fiber can be crimped using any conventional techniques used for PET or nylon fiber such as, for example, a mechanical stuffer box crimper. In some embodiments in carpet fiber, the crimped fiber has a crimp frequency of 5 or more, preferably 6 or more. For carpet, a crimp frequency of about 10 crimps per inch, or less, is generally suitable. For example, in preferred embodiments, a 6 dpf carpet fiber has a crimp frequency of about 9 crimps per inch, while a 18 dpf carpet fiber can have a crimp frequency of about 7 crimps per inch. Generally, for fibers having a lower denier than carpet fiber, such as, for example, for textile uses, it is desirable that the crimp frequency be up to about 14 crimps per inch or more. The particularly preferred crimp frequency is dependent upon end use and denier. Finer denier apparel staple generally requires higher crimp frequencies.

Fibers made according to the processes disclosed herein can be blended with other fibers for applications in a variety of textile applications, e.g., for making carpets, and fabrics for apparel and other uses. Blending of such other fibers with polyester fibers, such as those made according to the processes disclosed herein, can provide improvements in physical properties of the other fibers. Examples of fibers that can be blended with the fibers made according to the processes disclosed herein include cotton, rayon, PET, polypropylene, poly(lactic acid), nylon, acrylic, spandex, acetate, wool, and polybutylene terephthalate fibers.

After crimping, it is desired to thermo-fix the fiber with steam to maximize CTU and provide the needed card sliver cohesion. Thermo-fixing can be accomplished by applying steam to the fiber, for example, in a stuffer box, and heating the fiber to at least about 80° C. and preferably not higher than about 100° C.

After being thermo-fixed, the fiber is dried, during which time the fiber generally relaxes. Drying can be accomplished by exposing the fiber to heated air at a temperature of about 60° C. or more. However, it is preferred that the fiber is dried at a temperature not exceeding about 140° C., more preferably less than about 120° C., even more preferably about 60 to 100° C. With regard to drying, the temperatures recited refer to the ambient temperature. It has been found that the CTU is optimized when the fiber is dried at a temperature up to about 100° C. A CTU in the range of about 10% to about 60% is generally desirable and a CTU in the range of about 15% to about 60% is generally more desirable. A CTU of about 15 to about 45% is preferred for carpet end uses, and a CTU within the range of about 30 to about 50% is preferred for textile end uses.

The drawn relaxed fiber can be cut into staple fibers having a length depending on the end use in a conventional manner. For example, a staple length of about 6-8 inches is generally preferred for carpet fibers.

If desired, the fibers can be treated with anti-static agents, which agents are well known to those skilled in the art. Anti-static agents can be incorporated into the polymer and/or applied to the surface of the fiber. Anti-static agents can be, for example, nonionic, anionic, cationic or amphoteric. The nature and method for using an anti-static agent depends upon the intended application and the composition of the polymer, and appropriate anti-static agents and methods for their use can be determined by one skilled in the art.

The fibers can be used to make a variety of fabrics. Fabrics made from the PTT fibers can be, for example, woven, non-woven, knitted, or bonded. Fibers of 6 to 25 denier are suitable for making fabrics and also for making carpet, using known methods.

For apparel uses, it is generally preferred that the fibers have a tenacity of at least about 3.0 gpd (grams per denier, also referred to as "gm./den."), more preferably at least about 3.2 gpd, e.g., about 3.4 or 3.6 gpd or greater. For carpet uses, it is generally preferred that the fibers have a tenacity of at least about 2.2 gpd, more preferably at least about 2.4 gpd.

EXAMPLES

The following examples are intended to illustrate certain preferred embodiments of the invention. It will be recognized by persons skilled in the art that the optimum conditions will depend not only on the equipment and tow size and residence time but also on the desired balance between operability and physical properties needed.

Example 1

In this Example, PTT was processed on pilot plant equipment intended for use for nylon. Undrawn 55 dpf PTT trilobal filaments, having a modification ratio (MR) of 1.65 were produced by melt extruding pellets having a relative viscosity (LRV) of 52.0 and an intrinsic viscosity (IV) of 1.04 in a conventional manner at 252-257° C. with a spinning speed of about 360 ypm, applying a finish, and piddling into a can. The intrinsic viscosity (IV) was determined using viscosity measured with a Viscotek Forced Flow Viscometer Y900 (Viscotek Corporation, Houston, Tex.) for the polymer dissolved in 50/50 weight % trifluoroacetic acid/methylene chloride at a 0.4 grams/dL concentration at 19° C. following an automated method based on ASTM D 5225-92.

Although the fiber was easily drawn as spun, it could not be drawn after aging as can nylon or 2GT. It became very brittle and had essentially no elongation to break after aging due to storage for a week. This was totally unexpected based on nylon and 2GT experience as the fiber had been quenched to less than 25° C., well below its glass transition temperature (45° C.), and stored at less than 26° C.

TABLE 1

Spinning Conditions for Example 1

| Item | 55 dpf fiber | 8.3 dpf fiber |
|---|---|---|
| Fiber Cross-Section | 1.65 MR | Round |
| Capillary Cross-Section Area, sq.in. | .000228 | .0000503 |
| Capillary Density, N/cm$^2$ | 2.46 | 9.83 |
| Throughput, gm./min/hole | 1.87 | 0.45 |
| Capillary Shear Rate. I/sec. | 6339 | 9296 |
| Spin speed, ypm | 360 | 560 |
| Jet Velocity, fpm | 42.6 | 46.5 |
| Spun dpf (UDY) | 55 | 8.3 |
| UDY Tenacity, gm/den | 0.62 | 1.2 |
| UDY Elongation, % | 260 | 506 |

The 55 dpf fiber, after aging for one week, was drawn under the conditions listed in Table 2, labeled A-1 through A-5.

A finer denier count (8.3 dpf, in Table 1) fiber, having a round cross-section was also spun. The 8.3 dpf fiber was less brittle and had better drawability than the 55 dpf fiber, but the drawability obtained would be unacceptable for some commercial processes. The 8.3 dpf fiber, also after aging for one week, was drawn under the conditions listed in Table 2, labeled B-1 and B-2.

It was found, based on Instron testing, that the initially brittle fibers could be drawn satisfactorily if they were drawn under hot and wet conditions as shown in Table 2. An Instron® Tensile Tester Model 1122 was used. The Instron® tester is a high precision electronic test instrument designed for testing a variety of materials under a broad range of test conditions. This device can be used for measuring both the force and the distance required to break either a single filament or a multifilament tow by stretching between two clamps. The bottom clamp is stationary and the upper clamp is moved at a preset speed. A load cell attached to the upper clamp measures the force generated on the tow. All PTT measurements on this particular Instron were done on yarn in the form of undrawn rope. This instrument has a clamp head speed that can be adjusted between 0.002 and 50 inches per minute.

The relatively slow spin speeds, as shown in Table 1, are suitable for two step spin processes for higher dpf spinning with equipment designed for higher spinneret capillary densities and shorter quench zones (less than 16 feet).

TABLE 2

| | Example 1: Testing on Instron ® Tester, @ 500 mm/min | | | |
|---|---|---|---|---|
| Item | Draw temp., ° C. | Wet or Dry | Max Draw Ratio | Draw force variation* |
| A-1 (55 dpf) | 22 | Dry | Not drawable | — |
| A-2 (55 dpf) | 16 | Wet | 4.5:1 | 5 |
| A-3 (55 dpf) | 38 | Wet | 4.6:1 | 4 |
| A-4 (55 dpf) | 52 | Wet | 4.6:1 | 1 |
| A-5 (55 dpf) | ~55 | Dry | 2.7:1 | 3 |
| B-1 (8.3 dpf) | 22 | Dry | 3:1 | — |
| B-2 (8.3 dpf) | 44 | Wet | 4.6:1 | 1 |

*1 = low draw force variation: 5 = high draw force variation

Table 2 reports the results of a single draw of fibers of 55 dpf (Runs A1 through A5) and 8.3 dpf (Runs B1 and B2). Both types of fiber exhibited brittleness before drawing. Each type of fiber was drawn wet and dry for comparison. Results reported are maximum draw ratio before breaking and draw force variation. Draw force variation, a value provided by Instron measurements, is an indicator of uniformity. A lower draw force variation (as shown in Table 2, A4 and B2) indicates a lower variability and is thus desirable.

Although heat alone or moisture alone helped draw the brittle fiber, it was clear that the most uniform draw was obtained by using both heat and moisture as evidenced by the draw force variation. When drawn in the absence of heat and moisture, the fiber had high denier or undrawn harsh sections. These results indicate that hot and wet conditions are preferred to draw PTT fibers and overcome structure changes due to aging.

Comparative Examples (CE2A Through CE2F) and Example 2G

These examples illustrate the properties of PTT processed on commercial nylon melt spun extrusion and drawing equipment. PTT fibers, 40 dpf, 1.65 MR trilobal filaments, were produced by melt extruding 52.2 LRV flake in a conventional manner at 266° C., with a spinning speed of about 430 ypm, applying a finish, and combining the ends into a spun rope and piddling the rope into cans. The rope from the cans was combined into a tow and drawn at about 100 ypm in a conventional manner. Drawing conditions are shown in Table 3. Spinning conditions are as follows: Spin temperature was 265° C.; the spinneret capillary cross sectional area was 0.000228 $in^2$; the capillary throughput was 1.87 g/min; the capillary shear rate was 6339 $sec^{-1}$; the spin speed was 430 ypm; the capillary jet velocity was 42.6 feet per minute; the capillary density was 2.46 $N/cm^2$; the undrawn yarn temperature was 25° C.; and the undrawn yarn was 40 denier.

The initial conditions tested were with the least aged fiber possible, a two-hour old very small creel stock, at room temperature without additional water or dilute finish. Even after this short time, the fiber was not drawable without providing warm and wet conditions in the draw zones (Comparative Example 2 A (CE2A)). Modifications to the draw machine to apply hot water with a prefeed kiss roll and spraying hot water in the drawn zone at about 45° C. permitted operation but gave variable properties, which is believed to be due to the spray providing only surface wetting of a thick bundle. This indicates that more uniform treatment conditions for each filament, such as wetting under water or solution, are preferred.

The fiber was initially drawable at up to 2.9× (2.9× its original length, which can also be expressed as a draw ratio of 2.9:1; Comparative Example 2B) but after 8 hours could only be drawn at 2.5× (Comparative Examples 2C and 2D). The fiber contained harsh undrawn sections as evidenced by the high variations in denier and elongation standard deviation (S.D.). The fiber was found to be completely undrawable after about 30 hours due to total bundle breaks, even at the lowest draw ratio possible (2.3:1) on this equipment (Comparative Example 2F).

The draw conditions used above did not provide adequately uniform treatment for the filaments or sufficient heat, and also could not overcome draw problems due to aging. These conditions did not provide adequate heat or moisture penetration into the tow. The result was variable denier, including some sections that were essentially undrawn and very harsh and brittle. The harsh sections also were found later to produce excessive fly in carding and harsh carpet fibers.

It was also found that heat setting the drawn fiber in an autoclave at 135° C. (Comparative Example 2E) made it much more brittle and reduced the tenacity from 2.1 to 0.7 gpd. (Such a treatment is common in carpet fiber manufacture to modify physical properties and shrinkage and such tenacity loss is highly undesirable.) This result illustrates that the fiber structure was also still unstable at these low draw ratios, and that higher draw ratios to better orientate and stabilize the fiber are required.

Drawing the fiber on a modified draw machine with a pre-draw dip tank at 45° C. and using a steam jet for the second drawing stage ("Draw 2") gave acceptable drawability (Example 2G), even after 3 months aging, which demonstrated that the brittle fiber could be successfully drawn to 3.9×, with acceptably uniform properties and without any harsh sections. Underwater wetting of a thin band of filaments and heating such a band gave dramatic improvements over surface treatments. These results demonstrated that effects of fiber aging can surprisingly be reversed and a dry draw machine can be modified for use in producing satisfactory fiber from PTT.

TABLE 3

Example 2 Drawing Conditions

| | Drawing Conditions | | | | | | |
|---|---|---|---|---|---|---|---|
| | CE2A | CE2B | CE2C | CE2D | CE2E | CE2F | 2G |
| Wet or Dry Draw | Dry | Wet | Wet | Wet | Wet | Wet | Wet |
| Draw Temperature, ° C. | 24 | 45 | 45 | 45 | 45 | 45 | 45-50 |
| Draw Speed, ypm | 100 | 100 | 100 | 100 | 100 | 100 | 100 |
| Draw ratio - initial predraw | 1.8:1 | 1.8:1 | 1.8:1 | 1.8:1 | 1.8:1 | 1.8:1 | 1.8:1 |
| Total draw ratio | 2.3:1 | 2.9:1 | 2.9:1 | 2.5:1 | 2.5:1 | 2.5:1 | 3.9:1 |
| Draw 2 Steam Jet | No | No | No | No | No | No | Yes |
| Time after extrusion, hrs | 2 | 2 | 8 | 16 | 16 | 30 | 3 months |
| Autoclave, 135° C. Steam after crimping | No | No | No | No | Yes | No | No |
| Denier & range | Not operable | 18 | Not operable | 22/11-32 | 21 | Not operable | 11 |
| Tenacity, gpd | | 2.2 | | 2.1 | 0.7 | | 3.4 |
| Elongation, % | | 64 | | 167 | 82 | | 71 |
| Elongation %, std. deviation | | 13 | | 56 | | | 6 |

Example 3

This example demonstrates drawing of the aged brittle 55 dpf undrawn yarn of Example 1 under a series of processing conditions. Results are shown in Table 4. The draw machine was capable of single or two stage draw, prewetting the fiber in a dip tank, drawing under water or dilute finish in the first stage ("Draw 1"), and drawing in the second stage ("Draw 2") under hot sprays or with a steam jet over a range of temperatures in these zones. The draw/crimp zones were coupled to a dryer, and the drawn fiber could be crimped and relaxed/ dried over a range of conditions. The equipment used for these trials is shown in FIG. 1.

The UDY produced in Example 1 was drawn, crimped, and relaxed as described below. The processing conditions allowed the fiber to be drawn at up to 5.6×, instead of being essentially undrawable as on the nylon equipment described in Example 2, with much better properties and no harsh undrawn sections, even after lagging the fiber for 60 days.

The predraw dip tank was found to improve draw uniformity. As shown in Examples 3A and 3B, excessive heat can crystallize the fiber and reduce drawability and operability due to broken filaments. A single draw stage gave satisfactory operability at up to 3.3× with the prefeed dip tank and dip draw and fair performance at 3.6× (Example 3A). Two draw stages gave improved drawability. Example 3C showed that a 4.5× was obtainable with more draw taken in the second stage i.e. a higher percentage of the total draw in the second stage than in the first stage (40% in Draw 1 and 60% in Draw 2). However, if more draw was taken in the first stage, (56% in Draw 1) a 5.5× draw was feasible (Example 3F shows properties at 5×).

It was found that too high of a temperature in the first draw stage (90° C.—Example 3E) did not provide as good operability as did a first draw state at 50° C. (Example 3F) and reduced the maximum draw ratio, presumably because of excessive crystallization. The best performance was observed under the conditions used in Example 3F indicating lower temperatures are better than high.

TABLE 4

Example 3: Optimizing Drawing Conditions

| | Item | | | | | |
|---|---|---|---|---|---|---|
| | A | B | C | D | E | F |
| Predraw, ° C. | 22 | 85 | 22 | 22 | 22 | 22 |
| Draw 1, ° C. | 50-90 | 90 | 50 | 90 | 90 | 50 |
| Draw 2, ° C. | off | off | 98 | 60 | 60 | 60 |
| (Draw 1)/ (Draw 2) | 3.6/1 | 3.6/1 | 1.8/2.5 | 2.3/1.8 | 2.9/1.4 | 2.8/1.8 |
| Total Draw Ratio | 3.6:1 | 3.6:1 | 4.5:1 | 4.2:1 | 4.2:1 | 5.0:1 |
| % Draw 1 | 100 | 100 | 40 | 55 | 69 | 56 |
| Draw speed, ypm | 50 | 50 | 50 | 50 | 50 | 50 |
| Operability | Fair | Poor | Good | Good | Fair | Good |
| Denier | | | 12.7 | | | 13 |
| Tenacity, gm/den | | | 3.6 | | | 3.8 |
| Elongation, % | | | 52 | | | 52 |

Example 4

This example demonstrates another surprising effect found with PTT fibers: varying the thermo fixing of the fiber after crimping significantly affected both downstream processing operability and carpet bulk to a surprising degree based on nylon and PET experience. The same spun fiber as in Example 2 was converted to carpet tow on the equipment shown in FIG. 1 and was cut to a length of 6 inches. The staple was then converted into yarn on conventional modified worsted equipment. The fiber was ring spun into 3.25 cc with 5.1 t.p.i. and was plied to 4.9 t.p.i., and Suessen heat set at 200° C. It was then tufted into a ⅛ ga., 50 oz./sq.yd, with ⅝ inch pile height. The carpet was then disperse dyed on a continuous dye range and finished in a conventional manner.

Example 4A shows that without steam assist in crimping the fiber had a low CTU. In mill processing, the card sliver had a very low cohesion, even though the crimp frequency was similar to the other items, and could not be carded as the sliver pulled apart. Example 4B shows that with steam assist the process becomes operable and both the CTU and sliver cohesion are improved. Example 4C shows that lowering the dryer/relaxer temperature from 165 to 60° C. not only significantly improved the CTU but also improved the carpet bulk.

TABLE 5

Example 4: Tow Preparation and Carpet Yarn Evaluation

| | Item | | |
|---|---|---|---|
| | A | B | C |
| Spun dpf | 40 | 40 | 40 |
| Total spun denier | 212480 | 212480 | 212480 |
| Draw Conditions | | | |
| Prefeed, ° C. | 22 | 22 | 22 |
| Draw 1, ° C. | 50 | 50 | 50 |
| Draw 2, ° C. | 50 | 60 | 60 |
| Draw speed, ypm | 49 | 75 | 75 |
| Draw 1/Draw 2 | 1.8/1.7 | 2.2/1.7 | 2.2/1.7 |
| Total Draw ratio | 3.1:1 | 3.6:1 | 3.6:1 |
| Crimping Conditions | | | |
| Roll Pressure, psi | 25 | 20 | 20 |
| Gate Pressure, psi | 46 | 32 | 32 |
| Steam Pressure, psi | 0 | 15 | 15 |
| Relaxer Temperature, ° C. | 100 | 165 | 60 |
| Relaxer Time, min. | 6 | 6 | 6 |
| Staple Denier | 14.9 | 13.1 | 13.5 |
| Tenacity, gpd | 2.3 | 2.4 | 2.4 |
| Elongation, % | 107 | 81 | 90 |
| Boil-off Shrinkage, % | 2.4 | 0.2 | 1.8 |
| Dry Heat Shrinkage@ 196° C., % | 8.5 | 5.9 | 9.3 |
| Crimp Frequency, cpi | 7.6 | 6.8 | 6.9 |
| CTU | 8 | 13.5 | 39 |
| Finisher Sliver Tenacity, gms./grain | Cohesion too low to card | 1.3 | 2.1 |
| Relative Carpet Bulk | NA | 0 | +10% |

What is claimed is:

1. A process for producing 6 to 25 dpf carpet staple fiber comprising the steps of: melt spinning poly(trimethylene terephthalate) into fibers on equipment having a quench zone shorter than 16 feet; accumulating the fibers under conditions to produce an aged undrawn yarn; prewetting the aged undrawn yarn, said aged undrawn yarn consisting essentially of poly(trimethylene terephthalate), at a temperature less than about 45° C.; drawing the yarn under wet conditions at a temperature of from about 45° C. to about 95° C. in a first stage to a length of about 30 to about 90 percent of its final length; further drawing the yarn in a second stage at a temperature from about 45° C. to about 98° C. under wet conditions; crimping the drawn yarn; thermo-fixing the crimped yarn in the presence of steam at a temperature from about 80° C. to about 100° C.; and drying the crimped yarn at 60° C. to 140° C.

2. The process of claim 1, wherein said undrawn yarn is spun on equipment having a spinneret capillary density of at least 2/cm$^2$.

3. The process of claim 1, wherein the undrawn yarn is spun at a speed less than about 600 ypm.

4. The process of claim 1, wherein said prewetting and drawing are carried out under water or under an aqueous solution of processing finish.

5. The process of claim 1, wherein during said prewetting and drawing, said yarn is in the form of a spun rope of less than about 300,000 denier/inch.

6. The process of claim 1, wherein in said first draw stage, the yarn is drawn to a length from about 40 to about 70 percent of its final length.

7. The process of claim 1, wherein in said first draw stage, the yarn is drawn to a length from about 50 to about 55 percent of its final length.

8. The process of claim 1, wherein said first draw stage is carried out at a temperature of about 80° C. or less.

9. The process of claim 1, wherein said first draw stage is carried out at a temperature of about 70° C. or less.

10. The process of claim 1, wherein said first draw stage is carried out at a temperature of about 60° C. or less.

11. The process of claim 1, wherein said first draw stage is carried out at a temperature of about 50° C. to about 55° C.

12. The process of claim 1, wherein said second draw stage is carried out at a temperature of about 60° C. to about 80° C.

13. The process of claim 1 wherein said thermo-fixing is carried out at a temperature of about 85° C.

14. The process of claim 1 wherein said drawn yarn has a denier of 6 to 20 dpf.

15. The process of claim 1 wherein the crimped yarn is dried at a temperature from about 60° C. to about 100° C.

16. A process for producing 1 to 6 dpf textile staple fiber comprising the steps of: melt spinning poly(trimethylene terephthalate) into fibers on equipment having a quench zone shorter than 16 feet; accumulating the fibers under conditions to produce an aged undrawn yarn; prewetting the aged undrawn yarn, said aged undrawn yarn consisting essentially of poly(trimethylene terephthalate), at a temperature less than about 45° C.; drawing the yarn under wet conditions at a temperature of from about 45° C. to about 95° C. in a first stage to a length of about 30 to about 90 percent of its final length; further drawing the yarn in a second stage at a temperature from about 45° C. to about 98° C. under wet conditions; crimping the drawn yarn; thermo-fixing the crimped yarn in the presence of steam at a temperature from about 80° C. to about 100° C.; and drying the crimped yarn at 60° C. to 140° C.

17. The process of claim 16, wherein said undrawn yarn is spun on equipment having a spinneret capillary density of at least about 8/cm$^2$.

18. The process of claim 16 wherein said undrawn yarn is spun at a speed of 1300 ypm or less.

19. The process of claim 16 wherein said undrawn yarn is spun at a speed of 900 ypm or less.

20. The process of claim 16 wherein said prewetting and drawing are carried out under water or under an aqueous solution of processing finish.

21. The process of claim 16, wherein during said prewetting and drawing, said yarn is in the form of a spun rope of less than about 200,000 denier/inch.

22. The process of claim 16, wherein in said first draw stage, the yarn is drawn to a length from about 40 to about 90 percent of its final length.

23. The process of claim 16, wherein in said first draw stage, the yarn is drawn to a length from about 70 to about 90 percent of its final length.

24. The process of claim 16, wherein said first draw stage is carried out at a temperature of about 80° C. or less.

25. The process of claim 16, wherein said first draw stage is carried out at a temperature of about 70° C. or less.

26. The process of claim 16, wherein said first draw stage is carried out at a temperature of about 60° C. or less.

27. The process of claim 16, wherein said first draw stage is carried out at a temperature of about 50° C. to about 55° C.

28. The process of claim 16, wherein said second draw stage is carried out at a temperature of about 60° C. to about 80° C.

29. The process of claim 16, wherein said thermo-fixing is carried out at a temperature of about 85° C.

30. The process of claim 16, wherein said crimped yarn is dried at a temperature from about 60° C. to about 100° C.

31. A process for producing 6 to 25 dpf carpet staple fiber comprising the steps of: melt spinning poly(trimethylene terephthalate) into fibers; accumulating the fibers under conditions to produce an aged undrawn yarn; prewetting the aged undrawn yarn, said aged undrawn yarn consisting essentially of poly(trimethylene terephthalate), at a temperature less than about 45° C.; drawing the yarn under wet conditions at a temperature of less than 60° C. in a first stage to a length of about 30 to about 90 percent of its final length; further drawing the yarn in a second stage at a temperature from about 45° C. to about 98° C. under wet conditions; crimping the drawn yarn; thermo-fixing the crimped yarn in the presence of steam at a temperature from about 80° C. to about 100° C.; and drying the crimped yarn at 60° C. to 140° C.

32. The process of claim 31, wherein said first draw stage is carried out at a temperature of about 50° C. to about 55° C.

33. The process of claim 32, wherein said second draw stage is carried out at a temperature of about 60° C. to about 80° C.

34. The process of claim 33, wherein said thermo-fixing is carried out at a temperature of about 85° C.

35. A process for producing 1 to 6 dpf textile staple fiber comprising the steps of: melt spinning poly(trimethylene terephthalate) into fibers; accumulating the fibers under conditions to produce an aged undrawn yarn; prewetting the aged undrawn yarn, said aged undrawn yarn consisting essentially of poly(trimethylene terephthalate), at a temperature less than about 45° C.; drawing the yarn under wet conditions at a temperature of less than 60° C. in a first stage to a length of about 30 to about 90 percent of its final length; further drawing the yarn in a second stage at a temperature from about 45° C. to about 98° C. under wet conditions; crimping the drawn yarn; thermo-fixing the crimped yarn in the presence of steam at a temperature from about 80° C. to about 100° C.; and drying the crimped yarn at 60° C. to 140° C.

36. The process of claim 35, wherein said first draw stage is carried out at a temperature of about 50° C. to about 55° C.

37. The process of claim 36, wherein said second draw stage is carried out at a temperature of about 60° C. to about 80° C.

38. The process of claim 37, wherein said thermo-fixing is carried out at a temperature of about 85° C.

* * * * *